United States Patent [19]

Merla

[11] Patent Number: 4,700,509

[45] Date of Patent: Oct. 20, 1987

[54] SEALING GASKET BETWEEN A DOOR AND ITS RELATED SHOULDER ON A CABINET, IN PARTICULAR OF A REFRIGERATOR

[75] Inventor: Adriano Merla, Angera, Italy

[73] Assignee: Ilpea S.p.A., Malgesso, Italy

[21] Appl. No.: 902,124

[22] Filed: Sep. 2, 1986

Related U.S. Application Data

[63] Continuation of Ser. No. 697,979, Feb. 4, 1985.

[30] Foreign Application Priority Data

Feb. 8, 1984 [IT] Italy ..... 19503 A/84

[51] Int. Cl.[4] ..... E06B 7/19

[52] U.S. Cl. ..... 49/487; 49/478

[58] Field of Search ..... 49/487, 478; 277/80; 292/251.5

[56] References Cited

U.S. PATENT DOCUMENTS

| | | | |
|---|---|---|---|
| 2,928,145 | 3/1960 | Foley | 49/478 |
| 3,126,590 | 3/1964 | Monti | 49/478 |
| 3,241,198 | 3/1966 | Baermann | 49/478 |
| 3,869,873 | 3/1975 | Thomas | 49/478 |

FOREIGN PATENT DOCUMENTS

| | | | |
|---|---|---|---|
| 707945 | 4/1965 | Canada | 49/478 |
| 1416151 | 12/1975 | United Kingdom | 49/490 |

*Primary Examiner*—Kenneth J. Dorner
*Assistant Examiner*—Gerald A. Anderson
*Attorney, Agent, or Firm*—Stevens, Davis, Miller & Mosher

[57] ABSTRACT

Bellows gasket for creating in the closing position a tight seal between the door and its related shoulder in a cabinet, in particular in a refrigerator, characterized in that at least the side face of said bellows intended for facing, in its working position, the outside edge of said shoulder, is provided with at least two portions of substantially different stiffness, said two portion being separated by a hinge point.

4 Claims, 2 Drawing Figures

SEALING GASKET BETWEEN A DOOR AND ITS RELATED SHOULDER ON A CABINET, IN PARTICULAR OF A REFRIGERATOR

This application is a continuation of application Ser. No. 697,979 filed Feb. 4, 1985.

In the field of the production of cabinets, in particular cabinets for refrigerators, freezers, and other cabinets for cold storage, it is well known in the art to effect the necessary sealing in the closing position of the door, between the edges of the shoulder of the cabinet on one side, and the door and the possible counter-door on the other side, by means of a gasket made of soft material, such as rubber or plastics, provided on the whole perimeter of the door.

Such gasket has usually the form of a bellows gasket, having a tubular section, possibly provided with a seat, of tubular section too, to the purpose of housing an insert acting as a magnetic pole, capable of effecting a tight seal in cooperation with its counter-pole, either fixed on the edges of cabinet shoulder, or formed by the cabinet itself, should such a cabinet be made of steel sheet.

These gaskets must show good elastic properties in the direction perpendicular to the plane of the door, so as to be compressible and extensible enough along that direction, during the door opening and shutting stages. Such elastic properties must however be coupled with a sufficient side stability of the bellows, such as to prevent deformation effects of it, in particular under the high intensity action effected by the magnetic insert; to this regard, a severe fault is caused in particular on the rotation side, or hinge side, of the door, whose gasket is the first one to be interested by the pole/counter-pole magnetic interaction, during the opening and the shutting movements of the door: as a consequence, especially on the hinge side, if an adequate lateral stability is not present of the bellows, this latter tends to deform during the time, because of the attracting action exerted by the edge of the cabinet during the opening and closing stages, until even a reversing effect is obtained of the gasket towards the hinge. It is clear that such a deformation causes a tightness loss in the closing position.

Purpose of the present invention is therefore to identify a sealing gasket for cabinets, in which ideal characteristics are coupled of side stability of the bellows, as well as of elasticity of the bellows in the direction along which is undergoes the compressing action in the closing position.

Such purpose is in particular intended to solve the above reminded problem of gasket deformation.

In order to achieving such purpose, the present invention provides a bellows gasket effecting in the closing position a tight seal between the door and its related shoulder in a cabinet, in particular of a refrigerator, characterized in that at least the side wall of said bellows intended for being faced in its working position towards the outside edge of said shoulder, is provided with at least two portions of substantially different stiffness, said two portions being divided by a hinge point.

To the purpose of better showing the characteristics and the advantages of the invention, examples of practical embodiments are described hereinunder, with reference to the figures of enclosed drawings, such examples in no way being to be intended as limitative of the invention itself.

Figure 1:
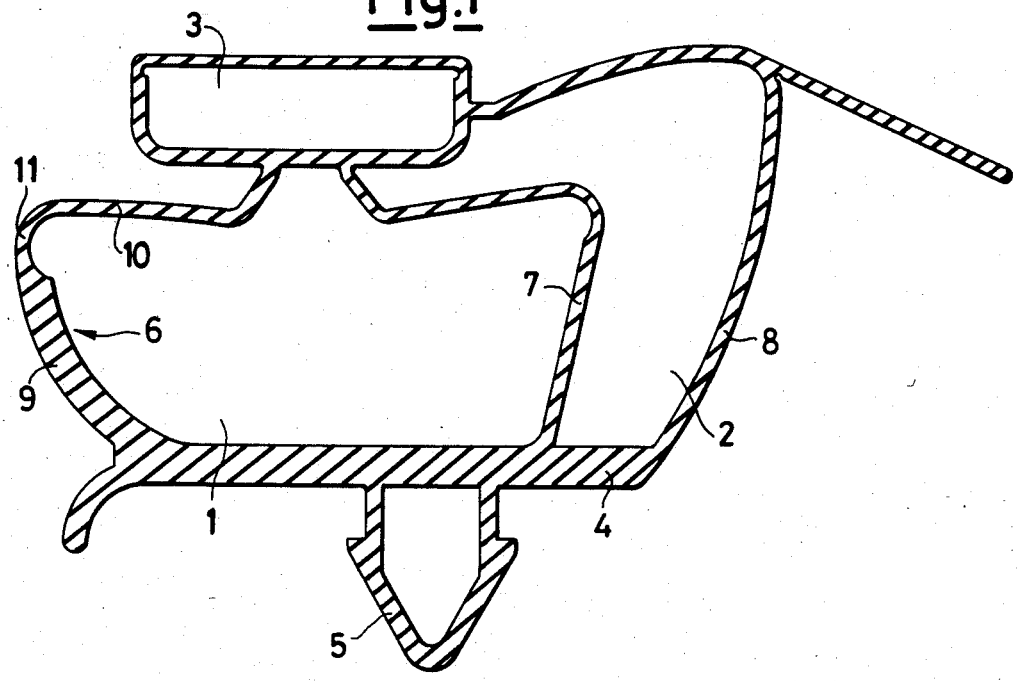
FIG. 1 shows a cross section view of a gasket according to the invention.

With reference to FIG. 1, a gasket according to the invention consists of a tubular section made of rubber or plastics, divided into a pair of chambers 1 and 2, acting as bellows, and into a third chamber 3 acting as the seat for an insert of magnetic material. The chamber 2 of the bellows is bounded sideways by a couple of walls 7 and 8. On the side intended for engaging the door, the gasket is bounded by a flat face 4, from which a pointedly shaped coupling element 5 protrudes, to the purpose of fastening the gasket by engaging a suitable hollow seat provided along the perimeter of the door.

The chamber 1 of the bellows is laterally bounded by two walls 6 and 7, of which, the wall 6 is the one intended for being faced, in its working position, towards the more external edge of the door engaging shoulder on the cabinet.

This wall 6 is provided with two portions 9 and 10, with substantially different stiffness, such difference being achieved, in the case of the example shown in FIG. 1, by a difference in thickness. The wall 6 shows therefore in this case, a sharp thickness decrease between the portion 9, of higher thickness, and the portion 10, of lower thickness, in a point indicated with 11; in this latter point, a hinging point is provided, so the portion 10 can perform vertical movements, by rotating relatively to 11, whilst the portion 9 does not undergo appreciable shifts.

Figure 2:
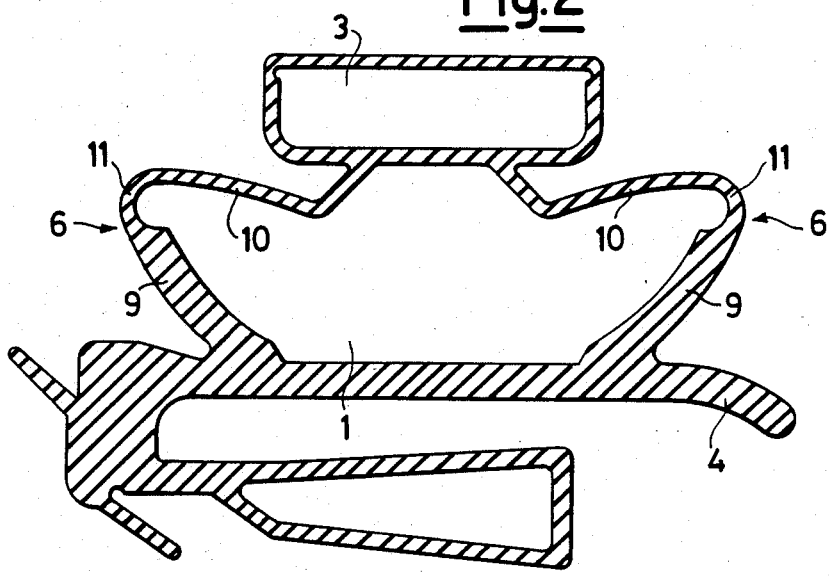
FIG. 2 shows a cross section view of another embodiment of the invention.

In the example shown in FIG. 2, a gasket according to another embodiment of the invention shows a bellows chamber 1, which is bounded in its lower part by a face 4 intended for engaging the door, and sideways by a couple of walls 6 provided with portions 9 and 10 with different thickness separated by a hinge point 11; the gasket comprises finally a chamber 3 suitable to house a magnetic insert.

The particular structure with differential stiffness of the walls 6 of the bellows allows a high lateral stability to be obtained of the gasket, mainly supplied by the section 9, together with optimum elasticity and compressibility characteristics, due to the compliance of portion 10.

In the practical embodiment shown in FIG. 1, such features are shown only in the wall intended for engaging in its working position the external edge of the shoulder of the cabinet, with which the door cooperates in its closing position, zone in which—as outlined hereinabove—the problem of gasket deformation is felt to the highest degree.

In the embodiment shown in FIG. 2, such features are shown by both bellows side walls, a gasket being therefore provided with sweepingly improved characteristics of lateral stability and elasticity.

In the examples shown in the figures, the characteristic of the differential stiffness of the side walls of the bellows is achieved by moulding the gasket from one material only, with different thicknesses. Such difference in stiffness can be achieved, in a further embodiment of the invention, by e.g. forming the gasket by coextrusion of two materials of different stiffness, with equal or different thicknesses: when so doing, the material forming the portion shown with 9 in the enclosed drawings shall be provided with higher stiffness in comparison to that of portion 10, it being allowed in this case that the related thicknesses of the two portions be the same.

Many other different embodiments are possible of the gasket of the invention, compared to those shown for exemplifying purposes, e.g., as to the shape of the face intended for engaging the door, or to the type of bellows used; the gasket moreover may be of a not magnetic type, in such case the sealing for tightness being achieved by compressive action only.

It is then possible to provide the gasket according to the invention in working position either on the hinge side of the door only, or also on one or more remaining sides of the same door.

The stiffness degree of each one of the two different portions of the side wall of the bellows in a gasket according to the invention shall then be suitably studied on the basis of the specific requirements typical of every different application, the inventive conception being always held firm of forming such side wall with two portions of substantially different stiffness, so that a hinge point be defined between them.

I claim:

1. A magnetic gasket for effecting a tight seal between a door and its related shoulder of a cabinet, comprising a chamber having a plurality of sides and acting as a seat for a magnetic insert and a tubular bellows section having a base and two sides extending from the base, said sides having ends, said ends of said sides being attached to one side of said chamber to form with said base said tubular bellows section, at least one of said sides defining sections of different degrees of stiffness coming to a point of interconnection, said point of interconnection acting as a pivot for deformation as a result of closing the door, said section of a higher degree of stiffness being positioned between the base and said section of a lower degree of stiffness with sufficient side stability of the bellows as to prevent deformation effects during closing of the door.

2. The gasket of claim 1 including a coupling element for attachment to the door protruding from the base in a direction opposite to the sides.

3. The gasket of claim 1 wherein both sides define sections of different degrees of stiffness and said sections in each side interconnect which interconnection acts as a pivot point for deformation.

4. The gasket of claim 1 wherein both sides define sections of different degrees of stiffness and said sections in each side interconnect which interconnection acts as a pivot point for deformation, each said side having said sections formed of different materials.

* * * * *